US010577734B2

(12) United States Patent
Verschut et al.

(10) Patent No.: US 10,577,734 B2
(45) Date of Patent: Mar. 3, 2020

(54) NONWOVEN MATERIAL

(71) Applicant: BONAR B.V., Arnhem (NL)

(72) Inventors: Cees Verschut, Wijchen (NL); Rob Tyler, Canton, NC (US); Ype Zijpp Van Der, Wijhe (NL); Pepijn Kuik, Eerbeek (NL)

(73) Assignee: LOW & BONAR, Arnhem (NL)

( * ) Notice: Subject to any disclaimer, the term of this patent is extended or adjusted under 35 U.S.C. 154(b) by 194 days.

(21) Appl. No.: 14/902,366

(22) PCT Filed: Jun. 11, 2014

(86) PCT No.: PCT/EP2014/062074
§ 371 (c)(1),
(2) Date: Dec. 31, 2015

(87) PCT Pub. No.: WO2015/000663
PCT Pub. Date: Jan. 8, 2015

(65) Prior Publication Data

US 2016/0369438 A1 Dec. 22, 2016

(30) Foreign Application Priority Data

Jul. 3, 2013 (EP) ..... 13174824

(51) Int. Cl.
*D04H 1/00* (2006.01)
*D04H 3/018* (2012.01)
(Continued)

(52) U.S. Cl.
CPC ..... *D04H 1/005* (2013.01); *D04H 1/4391* (2013.01); *D04H 1/541* (2013.01); *D04H 1/559* (2013.01); *D04H 3/018* (2013.01); *D04H 3/147* (2013.01)

(58) Field of Classification Search
CPC ..... D04H 1/00; D04H 1/005; D04H 1/4391; D04H 1/541; D04H 1/558; D04H 1/559; D04H 1/06; D04H 3/14; D04H 3/147; D04H 13/00; D04H 1/54; D04H 3/018; B32B 2262/0253; B32B 2262/0261;
(Continued)

(56) References Cited

U.S. PATENT DOCUMENTS

D34,119 S 2/1901 Baron
D51,320 S 10/1917 Nathan
(Continued)

FOREIGN PATENT DOCUMENTS

EM 002267229-0003 7/2013
EM 002267229-0004 7/2013
(Continued)

OTHER PUBLICATIONS

Design U.S. Appl. No. 29/492,807, filed Jun. 3, 2014 in the name of Verschut.

(Continued)

*Primary Examiner* — Camie S Thompson
(74) *Attorney, Agent, or Firm* — Oliff PLC

(57) ABSTRACT

A material including at least one nonwoven layer of fibers is provided comprising textured yarns, preferably knit-deknit yarns. The textured yarns included in the material enables the mechanical properties of the material to be adjusted to enable the material to conform to high local deformations.

18 Claims, 3 Drawing Sheets

(51) Int. Cl.

| | |
|---|---|
| ***D04H 3/147*** | (2012.01) |
| ***D04H 1/4391*** | (2012.01) |
| ***D04H 1/541*** | (2012.01) |
| ***D04H 1/559*** | (2012.01) |

(58) Field of Classification Search

CPC . B32B 2262/12; B32B 2262/14; B32B 5/022; B32B 27/36; D06N 2201/10; D06N 7/0068; Y10T 428/2929; Y10T 442/637

USPC ..... 442/327, 33, 352, 361–364, 402, 403, 442/408, 328, 341, 411, 362, 363; 428/373, 212

See application file for complete search history.

(56) References Cited

U.S. PATENT DOCUMENTS

| | | | | |
|---|---|---|---|---|
| D88,306 | S | 11/1932 | Megroz | |
| D88,769 | S | 12/1932 | Gottesman | |
| D88,869 | S | 1/1933 | George | |
| D122,658 | S | 9/1940 | Cembalest | |
| 2,858,247 | A | 10/1958 | De Swart | |
| 3,692,622 | A | 9/1972 | Dunning | |
| D254,015 | S | 1/1980 | Adolph | |
| 4,769,880 | A * | 9/1988 | Heinrich | D02G 1/002 28/218 |
| 5,382,400 | A | 1/1995 | Pike et al. | |
| 5,635,290 | A * | 6/1997 | Stopper | D04H 1/54 428/157 |
| D414,611 | S | 10/1999 | Barnholtz et al. | |
| 6,329,051 | B1 | 12/2001 | Groh et al. | |
| D458,695 | S | 6/2002 | Langue | |
| 6,492,020 | B1 | 12/2002 | Ahn et al. | |
| D659,265 | S | 5/2012 | Kurtz | |
| D695,552 | S | 12/2013 | Gatto | |
| 2004/0007145 | A1 | 1/2004 | Franz et al. | |
| 2004/0253888 | A1* | 12/2004 | Iedema | D04H 1/44 442/59 |
| 2004/0265577 | A1* | 12/2004 | Goda | D01F 6/92 428/364 |
| 2005/0039836 | A1* | 2/2005 | Dugan | D01F 8/04 156/62.2 |
| 2008/0070465 | A1 | 3/2008 | Wiles | |
| 2008/0206541 | A1 | 8/2008 | Medoff | |
| 2009/0176054 | A1 | 7/2009 | Laib et al. | |
| 2011/0171831 | A1* | 7/2011 | Hsu | B24B 37/24 438/692 |
| 2011/0189918 | A1 | 8/2011 | Zhao et al. | |
| 2014/0170918 | A1 | 6/2014 | Angus, Jr. et al. | |

FOREIGN PATENT DOCUMENTS

| | | | |
|---|---|---|---|
| EM | 002267229-0006 | | 7/2013 |
| GB | 862 545 | A | 3/1961 |
| GB | 1 192 351 | A | 5/1970 |
| JP | 2002-20956 | A | 1/2002 |
| JP | 2002-020956 | * | 7/2002 |
| TW | 237489 | B | 1/1995 |
| WO | 2012/120324 | A1 | 9/2012 |

OTHER PUBLICATIONS

Aug. 31, 2015 Office Action issued in Design U.S. Appl. No. 29/492,807.

Jul. 3, 2014 International Search Report issued in International Patent Application No. PCT/EP2014/062074.

Jul. 3, 2014 Written Opinion issued in International Patent Application No. PCT/EP2014/062074.

Nov. 16, 2015 International Preliminary Report on Patentability issued in International Patent Application No. PCT/EP2014/062074.

Nov. 3, 2017 Office Action issued in Chinese Patent Office Application No. 201480037724.1.

Feb. 17, 2017 Office Action issued in Chinese Patent Office Application No. 201480037724.1.

* cited by examiner

NONWOVEN MATERIAL

BACKGROUND

The disclosure pertains to a material comprising at least one nonwoven layer of fibers and to a process to manufacture said material.

Nonwoven materials are used in many industrial applications, such as for example drainage materials, building materials and packaging materials. The nonwoven materials used in industrial applications generally have high tensile strength and high modulus. Nonwovens in industrial applications may be subjected to high local deformations, for example when being used as packaging material around irregular shaped objects or when being moulded into complex three-dimensional shapes. High modulus nonwovens may lack the capability to conform to such high local deformations.

GB 1,192,351 discloses a method for manufacturing a flexible sheet material by forming a mat of crimped continuous filaments wherein the crimped continuous filaments are supplied under tension, subsequently releasing the tension to create interpenetration of the filaments at random in three dimensions, and bonding the filaments together by at least one resinous or elastomeric bonding agent applied in the form of dispersion or a solution.

BRIEF SUMMARY

It is an object of the disclosure to provide a material comprising at least one nonwoven layer of fibers having the capability to conform to high local deformations.

The object of the disclosure is achieved by a material described herein.

The presence of the textured yarn in the nonwoven layer of fibers enables the mechanical properties of the material to be adjusted to enable the material to conform to high local deformations.

DETAILED DESCRIPTION

Figure 1:
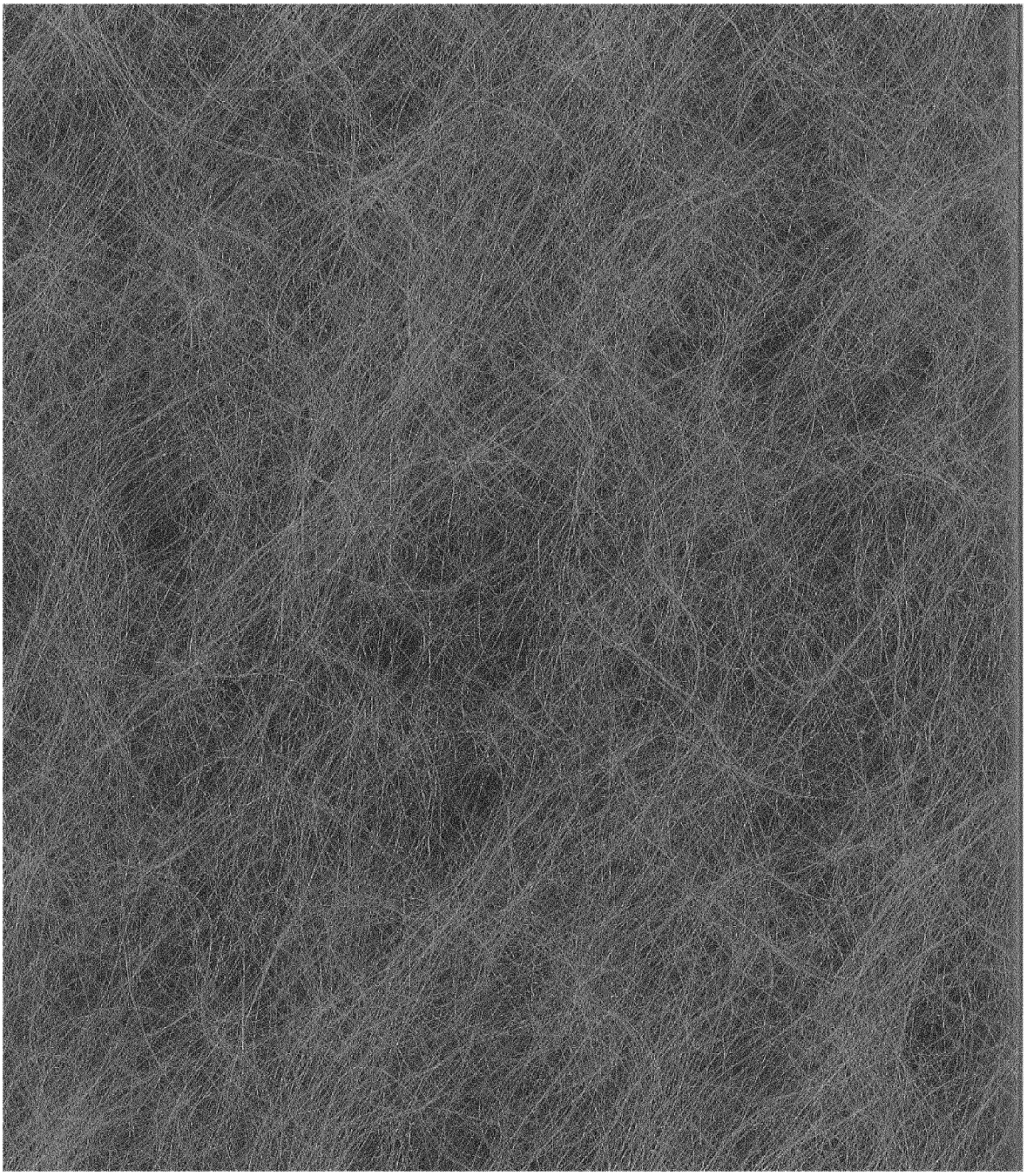
FIG. 1 is a photograph of a sample in accordance with the comparative example.

The term fibers as used herein refers both to staple fibers and filaments.

A textured yarn is to be understood to be a yarn that has been processed to introduce durable distortions along the length of the fibers and/or filaments of the yarn, such as crimps, coils, loops, crinkles or other distortions or any combination thereof.

As is well-known to the person skilled in the art, a nonwoven layer of fibers essentially has a two-dimensional shape, wherein the thickness of the nonwoven layer of fibers is at least one order of magnitude, more preferably at least two orders of magnitude, more preferably at least three orders of magnitude smaller than both the width and the length of the nonwoven layer of fibers.

The thickness of the nonwoven layer of fibers is in the range of 0.05 to 10 mm, preferably in the range of 0.10 to 5.0 mm, more preferably in the range of 0.2 to 2.0 mm, more preferably in the range of 0.3 to 1.0 mm.

The length of the processed textured yarn is less as compared to the length of the yarn having the same weight before being processed into a textured yarn due to the formation of the durable distortions. The length of a yarn is determined, without applying a load to the yarn, by fixing one end of the yarn in a clamp and measuring the distance of the other end of the yarn to the clamp, wherein the length of the yarn before being processed into a textured yarn preferably is 1.0 m. The ratio of the length of the textured yarn over the length of the yarn before being processed is 0.90 or less, preferably 0.75 or less, more preferably 0.60 or less, most preferably 0.50 or less. Preferably the ratio of the length of the textured yarn over the length of the yarn before being processed is at least 0.20, more preferably at least 0.30, most preferably at least 0.40. By reducing the ratio of the length of the textured yarn over the length of the yarn before being processed, the number of distortions and/or the size of the distortions in the textured yarn is increased, which increases the maximum elongation of the textured yarn at breakage and/or reduces the modulus of the textured yarn at small elongations, for example at 2%, 5% or 15% elongation. When the ratio of the length of the textured yarn over the length of the yarn before being processed is 0.40 or less, the number of distortions may increase to a level where the risk of entanglements being formed between distortions in the textured yarn increases, which may reduce the maximum elongation of the textured yarn at breakage and/or increase the modulus of the textured yarn at small elongations.

Preferably, the number of distortions is at least 25 per meter length of the processed textured yarn, more preferably at least 50, even more preferably at least 75, most preferably at least 100 per meter length of the processed textured yarn. Preferably, the number of distortions is 250 or less per meter length of the processed textured yarn, more preferably 200 or less, even more preferably 150 or less, most preferably at least 125 or less per meter length of the processed textured yarn.

In an embodiment, the material comprising at least one nonwoven layer of fibers may consist completely of textured yarns.

Durable distortions may be introduced into a yarn by any suitable process, such as for example by twisting the yarn, heat-setting the twisted yarn and untwisting the heat-set twisted yarn, either in a continuous process or in a three-stage process, or by passing the yarn through a heated stuffer box. The yarn may also be processed by heating the yarn and passing the heated yarn over a knife edge or by passing the heated yarn between a pair of geared wheels. The yarn may also be processed into a textured yarn by air-texturizing the yarn.

Preferably, the yarn is processed into a textured yarn by knitting the yarn into a fabric, optionally heat-setting the knitted fabric, and unravelling the knitted fabric into knit-deknit (KDK) yarns. Knit-deknit yarn have the advantage that the unravelled yarns can be wound as straight yarns on bobbins, provided that sufficient tension is applied during winding, thereby reducing the risk of entanglements on the bobbins. Releasing the tension by unwinding the KDK yarns re-establishes the durable distortions in the textured yarns.

Heat setting of the knitted fabric is preferably executed in an oven at an elevated temperature, preferably above the glass transition temperature of the polymers comprised in the fibers and/or filaments of the yarn. Steam may additionally be introduced into the oven to increase the heat transfer into the knitted fabric being heat set.

The knitted fabric may additionally be dyed in any desired pattern using any known dyeing or printing technique. The knitted fabric may for example be dyed with at least two different colors. The unravelled knit-deknit yarns may thus comprise sections of different color along the length of the textured yarn. The at least one nonwoven layer of fibers comprising knit-deknit yarns having sections of different colour along the length of the yarn may have the different colors distributed randomly over its surface, which may be used for example for camouflage applications and/or for decorative purposes such as for example curtains, blinds and/or flower wrappings. In an embodiment, the knitted fabric is dyed with at least three different colors, preferably at least four, more preferably at least five different colors, such that the knit-deknit yarn has sections with at least two, three, four or five different colors along the length of the yarn.

The texturized yarns may be comprised of at least 10 wt. % of one or more thermoplastic polymers to enable thermal bonding in the textured yarns. Preferably, the textured yarns are comprised of at least 25 wt. %, more preferably at least 50 wt. %, more preferably at least 75 wt. %, more preferably at least 90 wt. % of one or more thermoplastic polymers. In a preferred embodiment, the textured yarns consist of 100 wt. % of one or more thermoplastic polymers.

The textured yarn may be a multifilament yarn. Preferably, the multifilament yarn comprises at least two different polymers. The at least two different polymers may exist in separate filaments comprised in the multifilament yarn or together in one filament comprised in the multifilament yarn. The at least two different polymers may also exist partly in separate filaments comprised in the multifilament yarn and partly together in one filament comprised in the multifilament yarn. Preferably, the melting points of the at least two different polymers differ by at least 10° C. More preferably the melting points differ by at least 50° C. The multifilament yarn comprising at least two different polymers may be thermally bonded by subjecting the yarn to a temperature of at least the melting point of the polymer with the lower melting point to increase the cohesion in the textured yarn. The at least two different polymers are preferably comprised in bicomponent filaments, such as for example side-by-side and/or core-sheath bicomponent filaments to ensure that cohesion between all filaments in the multifilament yarn is obtained. The textured yarn and/or the at least one layer nonwoven layer of fibers is thus thermally bonded by a polymer originating from the textured yarn.

The multifilament yarn may further comprise entanglements distributed along the length of the textured yarn to prevent the individual filaments of the multifilament yarn from being distributed in the nonwoven layer of fibers over a relatively large area. An entanglement is understood to be a section of the multifilament yarn where the filaments are firmly connected to each other such that the individual filaments in this section of the multifilament yarn remain together when being wound, unwound and/or introduced into the nonwoven layer of fibers. An entanglement may be formed in any suitable manner, for example by forming a knot, intertwining the filaments to form mechanical friction points and/or thermally bonding the filaments to each other.

When the multifilament yarn comprises entanglements, the distance between two consecutive entanglements limits the area of the nonwoven layer of fibers over which the individual filaments of the multifilament yarn can be distributed.

The filaments of the multifilament yarn may for example be intertwined by directing a fluid jet, preferably an air jet, for a desired period of time onto the multifilament yarn under an angle to the longitudinal direction of the yarn, preferably perpendicular the longitudinal direction of the yarn. Optionally the intertwined filaments may be thermally bonded to increase the strength of the entanglement.

If the yarn is stagnant when an individual entanglement is made, the length of the entanglement is determined by the width of the fluid jet. The distance between two consecutive entanglements along the length of the multifilament yarn can thus be selected as desired.

If the yarn is moving when an individual entanglement is made, the length of the entanglement is determined by the period of time during which fluid jet is directed onto the multifilament yarn and by the speed of the multifilament yarn. The distance between two consecutive entanglements along the length of the multifilament yarn is determined by the time between the end of the period of time during which fluid jet is directed onto the multifilament yarn for forming the previous entanglement and the start of the period of time during which fluid jet is directed onto the multifilament yarn for forming the next entanglement, and by the speed of the multifilament yarn.

The number of entanglements in the textured multifilament yarn may vary widely. Preferably, the number of entanglements in the multifilament yarn is at least 0.5 per meter length of the textured yarn, preferably at least 1.0 per meter length, more preferably at least 1.5 per meter length, most preferably at least 2.0 per meter length.

The length of an entanglement in the textured multifilament yarn may be at least 1 cm, preferably at least 5 cm, more preferably at least 10 cm, even more preferably at least 20 cm, most preferably at least 50 cm. The length of an entanglement in the multifilament yarn may even be the total length of the textured yarn. Preferably, the length of an entanglement in the multifilament yarn may is 10 m or less, preferably 10 m or less, more preferably 5 m or less, even more preferably 2.5 m or less, most preferably 1 m or less. Increasing the length of the entanglements in the multifilament yarn reduces the length of individual filaments spread out within the nonwoven layer of fibers thereby limiting the number of crossing points between the filaments of the multifilament yarn and other fibers and/or filaments contained in the nonwoven layer of fibers, which may be formed into bonding points, for example by thermal bonding, to adjust the mechanical properties of the material.

The distance between two consecutive entanglements in the textured multifilament yarn may vary widely. Preferably, the distance between two consecutive entanglements in the multifilament yarn is at least 5 cm, more preferably at least 10 cm, even more preferably at least 15 cm, most preferably at least 20 cm. The individual filaments between two consecutive entanglements in the multifilament yarn may be spread out within the nonwoven layer of fibers thereby creating an increase in crossing points between the filaments of the multifilament yarn and other fibers and/or filaments contained in the nonwoven layer of fibers, which may be formed into bonding points, for example by thermal bonding, to improve the cohesion of the material. Preferably, the distance between two consecutive entanglements in the multifilament yarn is 250 cm or less, more preferably 150 cm or less, even more preferably 100 cm or less, most preferably 75 cm or less. When the distance between two consecutive entanglements in the multifilament yarn increases, the mechanical properties of the material comprising the textured yarn in the nonwoven layer fibers will distinguish less from a material comprising a nonwoven layer fibers without the textured yarn.

The length of the consecutive entanglements in the textured multifilament yarn may be constant, may vary with any regular pattern or may be random to adjust the mechanical properties and/or the appearance of the material.

The distance between consecutive entanglements in the textured multifilament yarn may be constant, may vary with any regular pattern or may be random to adjust the mechanical properties and/or the appearance of the material.

In an embodiment of the material, the at least one nonwoven layer of fibers comprises at least 10 wt. % of textured yarn based on the total weight of the material, preferably at least 25 wt. %, preferably at least 50 wt. %, more preferably at least 75 wt. %, even more preferably at least 90 wt. %. The at least one nonwoven layer of fibers may also be composed entirely of textured yarn.

In an embodiment of the material, the at least one nonwoven layer of fibers has a weight of at least 15 $g/m^2$, preferably of at least 20 $g/m^2$, preferably of at least 25 $g/m^2$, more preferably of at least 30 $g/m^2$. Preferably, the at least one nonwoven layer of fibers has a weight of at most 500 $g/m^2$, preferably of at most 250 $g/m^2$, preferably of at most 150 $g/m^2$, more preferably of at most 100 $g/m^2$.

The linear density of the yarn before being processed into a textured yarn may vary over a wide range. Preferably, the linear density of the yarn is least 250 dtex, preferably at least 500 dtex, more preferably at least 1000 dtex, most preferably at least 1500 dtex. Preferably, the linear density of the yarn before being processed into a textured yarn is less than 5000 dtex, more preferably less than 2500 dtex, most preferably less than 2000 dtex.

The number of individual filaments in a multifilament textured yarn may vary widely. Preferably, the number of individual filaments in the multifilament textured yarn is at least 5, preferably at least 10, preferably at least 20, more preferably at least 50, more preferably at least 75, more preferably at least 100, more preferably at least 125.

The textured yarns may comprise wide variety of polymers including polyolefins, such as polyethylenes, for example linear low density polyethylene, high density polyethylene and/or (ultra) high molecular weight polyethylene, polypropylenes and/or copolymers or any blend thereof. The texturized yarns may also comprise polyesters, for example polyethylene terephthalate, polylactic acid, polybutylene terephthalate, polytrimethylene terephthalate and/or polyethylene naphthalate, or polyamides, for example polyamide-6, polyamide-6,6, polyamide-4,6, and/or copolymers or any blend thereof.

As described above, the texturized yarns may comprise two different polymers selected from a variety of polymers as described above. Preferred combinations are polyester/co-polyester, polyester/polyamide, polyamide/co-polyamide, polyester/polyolefin and polyamide/polyolefin.

In an embodiment of the material, the at least one nonwoven layer of fibers comprises textured yarns as described above and in addition further staple fibers and/or filaments, preferably also comprising at least two different polymers. Preferably, the polymer(s) comprised in the further staple fibers and/or filaments are thermoplastic polymers. The at least two polymers of the further staple fibers and/or filaments may exist either in separate staple fibers and/or filaments or together in one staple fiber and/or filament. The at least two different polymers of the further staple fibers and/or filaments may even exist partly in separate staple fibers and/or filaments comprised in the nonwoven layer of fibers and partly together in one staple fiber and/or filament comprised in the nonwoven layer of fibers. Preferably, the melting points of the at least two different polymers differ by at least 10° C., more preferably by at least 50° C. to enable thermal bonding. The at least one layer nonwoven layer of fibers is thus thermally bonded by a polymer originating from the textured yarn and/or from the further staple fibers and/or filaments.

The further staple fibers and/or filaments may comprise wide variety of polymers including polyolefins, such as polyethylenes, for example linear low density polyethylene, high density polyethylene and/or (ultra) high molecular weight polyethylene, and polypropylenes and/or copolymers or any blend thereof. The further staple fibers and/or filaments may also comprise polyesters, for example polyethylene terephthalate, polylactic acid, polybutylene terephthalate, polytrimethylene terephthalate and/or polyethylene naphthalate, or polyamides, for example polyamide-6, polyamide-6,6, polyamide-4,6, and/or copolymers or any blend thereof.

As described above, the further staple fibers and/or filaments may comprise two different polymers selected from a variety of polymers as described above. Preferred combinations are polyester/co-polyester, polyester/polyamide, polyamide/co-polyamide, polyester/polyolefin and polyamide/polyolefin.

Preferably, the texturized yarns and the further staple fibers and/or filaments comprise the same polymers as comprised in the textured yarns to optimize thermal bonding of the material.

Preferably, the further staple fibers and/or filaments do not comprise durable distortions.

The at least one nonwoven layer of fibers may thus comprise at least two staple fiber and/or filament types. The at least two staple fiber and/or filament types comprise different polymers with different melting points to form so-called bifil type nonwovens. The nonwoven layer of fibers may be thermally bonded by subjecting the nonwoven layer of fibers to a temperature of at least the melting point of the polymer with the lowest melting point of the at least two different polymers. The nonwoven layer of the bifil type will not be bonded at each crossing point since the staple fibers and/or filaments comprising the polymer with the higher melting point may cross each other. Only crossing points of staple fibers and/or filaments in a combination of high and low melting point or low and low melting point will be bonded, and not the crossing points of staple fibers and/or filaments with higher melting point.

The at least two polymers of the further staple fibers and/or filaments may exist together in one staple fiber and/or filament to form so-called bicomponent type nonwovens made from bicomponent fibers and/or bicomponent filaments. The nonwoven layer of fibers of the bicomponent type may be thermally bonded by subjecting the nonwoven layer of fibers to a temperature of at least the melting point of the polymer with the lower melting point. The bicomponent staple fibers and/or bicomponent filaments will be bonded at each crossing point of the bicomponent staple fibers and/or bicomponent filaments.

The linear density of the further staple fibers and/or filaments may vary over a wide range. Preferably, the linear density of the further staple fibers and/or filaments is at least 5 dtex per staple fiber or filament, more preferably at least 10 dtex, most preferably at least 15 dtex per staple fiber or filament. Preferably, the linear density of the further staple fibers and/or filaments is less than 50 dtex per staple fiber or filament, more preferably less than 25 dtex, most preferably less than 20 dtex per staple fiber or filament.

The mechanical properties of the material can thus be adjusted to conform with high local deformations by selecting the amount of textured yarns comprised in the material and the type of the further staple fibers and/or filaments comprised in the at least one nonwoven layer of fibers.

The material may comprise one or more additional material layers. Each of the additional material layers may be a film or a layer of fibrous material, such as a woven, a two-dimensional grid or scrim, a nonwoven or a three-dimensional entangled mat of extruded filaments.

Each of the additional material layers may be physically attached to the at least one nonwoven layer of fibers and/or to a further additional material layer of the material by any known manner, such as for example by thermal bonding, mechanical bonding, such as mechanical needling, hydro entanglement or stitching, or by adhesive bonding or ultrasonic bonding or any combination thereof.

The glass transition temperature and the melting temperature are determined by DSC measurement wherein the temperature is increased from 0° C. to 300° C. at a rate of 20° C. per minute. The glass transition (Tg) is an endothermic event, a change in heat capacity that is depicted by a shift in the baseline of the DSC measurement curve. It is considered the softening point of the material or the melting of the amorphous regions of a semi-crystalline material. The melting point (Tm) is the temperature at which a materials melts. It is measured as the peak temperature of an endothermic event.

EXAMPLES

Comparative Example

A nonwoven of 30 g/m$^2$ was produced from multifilament yarns consisted of core/sheath bicomponent filaments consisting of a polyester terephthalate (PET) core and a polyamide-6 (PA6) sheath in a ratio of 74/26 vol %/vol. %. The individual bicomponent filaments have a linear density of 15 dtex per filament. The multifilament yarns had a linear density of 1800 dtex. The multifilament yarns were opened into single filaments using a diffusor and laid down on a moving conveyor belt. The nonwoven was thermally bonded at a temperature of 230° C. using a through-air bonding drum. FIG. 1 shows a representative sample of the comparative example.

Example 1

A nonwoven of 30 g/m$^2$ was produced from 50 wt. % of textured yarns processed by the knit-deknit method and 50 wt. % of the yarns of comparative example. The yarns had a linear density of 1800 dtex before being processed into textured yarns. The ratio of the length of the textured yarn over the length of the yarn before being processed was 0.55.

Figure 2:
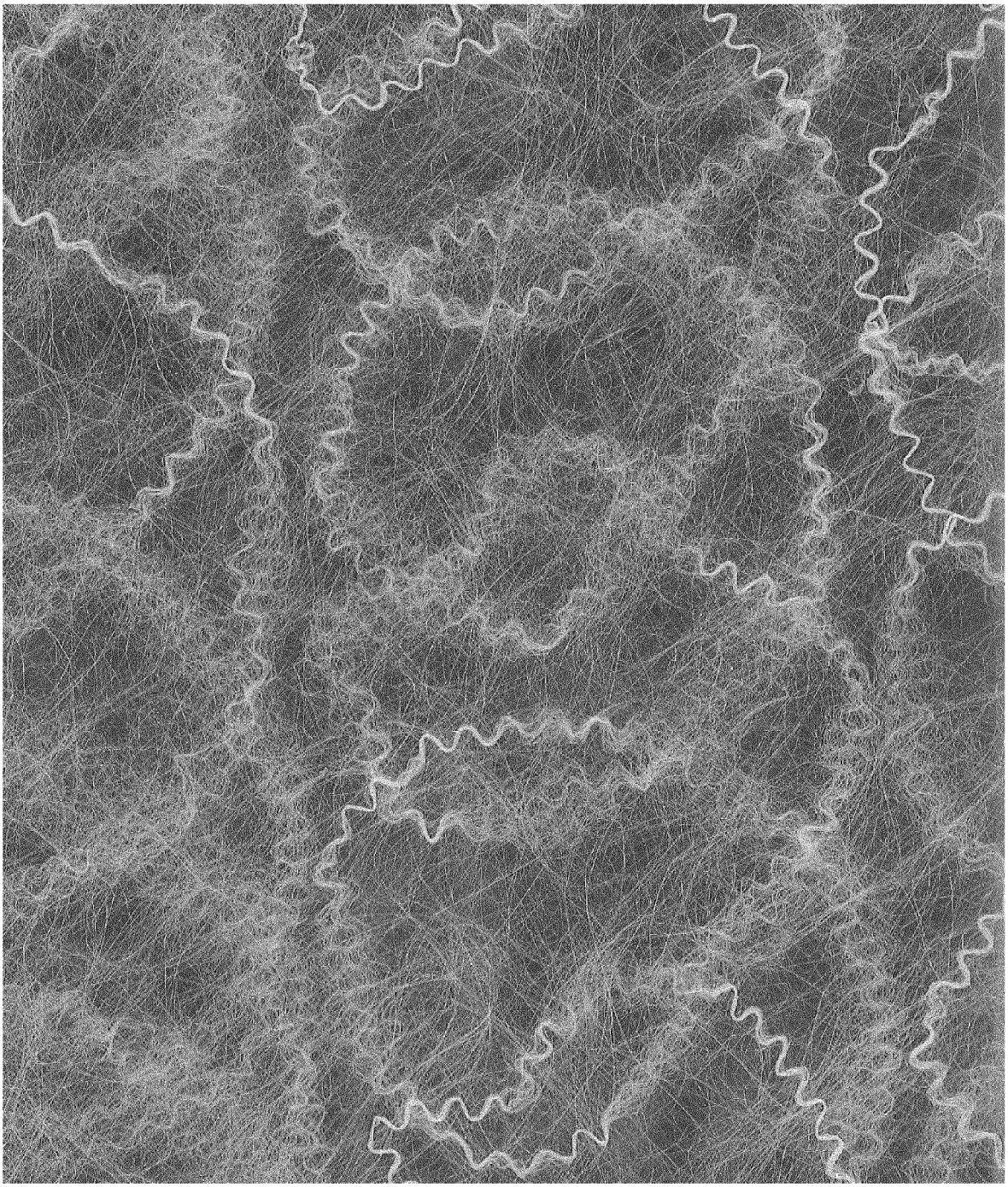
FIG. 2 is a photograph of a sample in accordance with example 1.

The multifilament yarns consisted of core/sheath bicomponent filaments consisting of a polyester terephthalate (PET) core and a polyamide-6 (PA6) sheath in a ratio of 74/26 vol %/vol. %. The individual bicomponent filaments have a linear density of 15 dtex per filament. The nonwoven was thermally bonded at a temperature of 230° C. using a through-air bonding drum. FIG. 2 shows a representative sample of the nonwoven of example 1.

Example 2

A nonwoven of 30 g/m$^2$ was produced entirely from textured yarns processed by the knit-deknit method. The yarns had a linear density of 1800 dtex before being processed into textured yarns. The ratio of the length of the textured yarn over the length of the yarn before being processed was 0.55.

Figure 3:
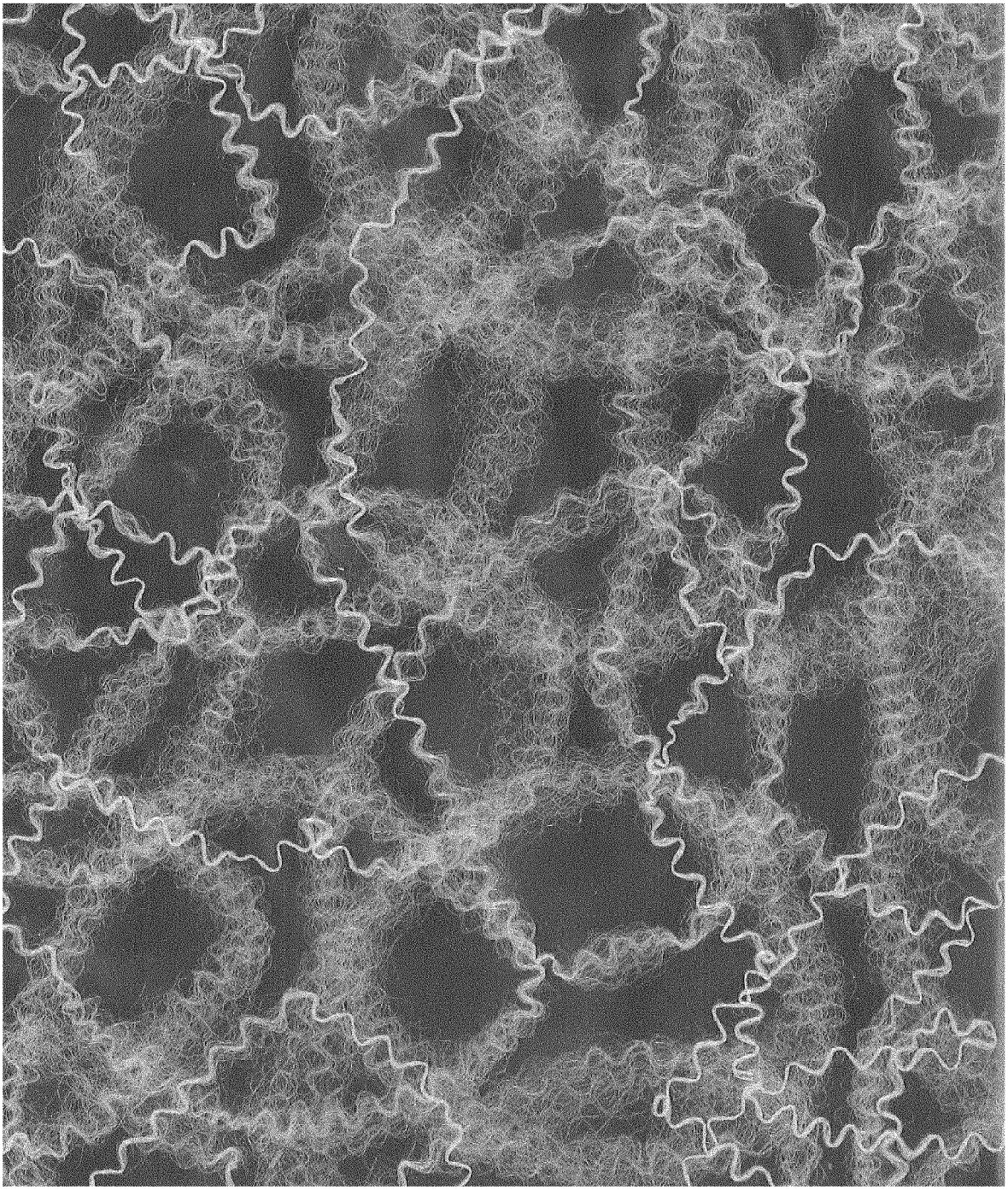
FIG. 3 is a photograph of a sample in accordance with example 2.

The multifilament yarns consisted of core/sheath bicomponent filaments consisting of a polyester terephthalate (PET) core and a polyamide-6 (PA6) sheath in a ratio of 74/26 vol %/vol. %. The individual bicomponent filaments have a linear density of 15 dtex per filament. The nonwoven was thermally bonded at a temperature of 230° C. using a through-air bonding drum. FIG. 3 shows a representative sample of the nonwoven of example 2.

Mechanical properties of the nonwovens have been determined in accordance with EN 29073-3 (08-1992), using a sample width of 20 cm, the sample being clamped over the entire sample width, and using a clamp speed of 200 mm/min. Table 1 summarizes the mechanical properties of the nonwovens comprising textured yarns.

TABLE 1

| | Example 1 | Example 2 | Comparative |
|---|---|---|---|
| Mass (g/m$^2$) | 31 | 30 | 30 |
| Maximum load (N/20 cm) | 169 | 34 | 313 |
| Elongation at maximum load (%) | 14 | 33 | 16 |
| LASE2 (N/20 cm) | 69 | 5 | 131 |
| LASE5 (N/20 cm) | 106 | 10 | 189 |
| LASE15 (N/20 cm)) | 140 | 21 | 248 |

The nonwovens comprising textured yarns have reduced modulus, i.e. load at specific elongation at 2% 5% and 15% elongation (LASE2, LASE5 and LASE15). The nonwoven consisting entirely of textured yarns exhibits an increased elongation at maximum load as compared to the comparative example. Depending the amount of textured yarns comprised in the material, the mechanical properties can thus be adjusted to enable the material to conform to high local deformations.

The invention claimed is:

1. A material comprising at least one nonwoven layer of fibers having a thickness, a width and a length, wherein the thickness of the nonwoven layer of fibers is at least one order of magnitude smaller than both the width and the length of the nonwoven layer of fibers, the at least one nonwoven layer of fibers comprises at least one textured yarn, the textured yarn is a multifilament yarn comprising at least two different polymers, and the textured yarn and/or the at least one nonwoven layer of fibers is thermally bonded by a polymer originating from the textured yarn.

2. The material according to claim 1 wherein the material comprises at least 10 wt. % of textured yarn based on the total weight of the material.

3. The material according to claim 1 wherein the ratio of the length of the textured yarn over the length of a yarn of the same weight before being processed into a textured yarn is 0.90 or less.

4. The material according claim 1 wherein the textured yarn comprises at least 25 distortions per meter length.

5. The material according to claim 1 wherein the at least one textured yarn is a knit-deknit yarn.

6. The material according to claim 5 wherein the knit-deknit yarn is a heat set knit-deknit yarn.

7. The material according to claim 6 wherein the multifilament yarn comprises bicomponent filaments.

8. The material according to claim 1 wherein the textured yarn has a linear density of at least 250 dtex.

9. The material according to claim 8 wherein the textured yarn has a linear density of at least 500 dtex.

10. The material according to claim 1 wherein the textured yarn comprises sections of different color along the length of the textured yarn.

11. The material according to claim 10 wherein the sections of different color are distributed randomly over the surface of the material.

12. The material according to claim 1 wherein the ratio of the length of the textured yarn over the length of a yarn of the same weight before being processed into a textured yarn is 0.60 or less.

13. The material according to claim 12 wherein the material comprises at least 50 wt. % of textured yarn based on the total weight of the material.

14. The material according to claim 13 wherein the multifilament yarn comprises core-sheath bicomponent filaments.

15. The material according to claim 1 wherein the at least two different polymers have different melting points.

16. The material according to claim 1 wherein the multifilament yarn comprises entanglements distributed along the length of the textured yarn.

17. The material according to claim 16 wherein a number of entanglements in the multifilament yarn is at least 0.5 per meter length of the textured yarn.

18. The material according to claim 17 wherein a distance between two consecutive entanglements in the multifilament yarn is at least 5 cm.

* * * * *